United States Patent [19]

Oldfield

[11] Patent Number: 4,891,015

[45] Date of Patent: Jan. 2, 1990

[54] UNIVERSAL CONNECTOR WITH INTERCHANGEABLE MALE AND FEMALE SLEEVES FOR USE IN NETWORK ANALYZERS AND MICROWAVE DEVICES

[75] Inventor: William W. Oldfield, Redwood City, Calif.

[73] Assignee: Wiltron Company, Morgan Hill, Calif.

[21] Appl. No.: 294,879

[22] Filed: Jan. 9, 1989

[51] Int. Cl.[4] ..... H01R 29/00

[52] U.S. Cl. ..... 439/172; 439/518; 439/638; 439/901; 439/903

[58] Field of Search ..... 439/166, 170–176, 439/323, 339, 469, 638, 651, 676, 578, 518, 901, 903

[56] References Cited

U.S. PATENT DOCUMENTS

| | | | |
|---|---|---|---|
| 3,210,720 | 10/1965 | Harris, Jr. | 439/518 |
| 3,673,546 | 6/1972 | Green et al. | 439/172 |
| 4,687,279 | 8/1987 | Holland et al. | 439/638 |

*Primary Examiner*—P. Austin Bradley

*Attorney, Agent, or Firm*—Fliesler, Dubb, Meyer & Lovejoy

[57] ABSTRACT

A universal connector assembly having a plurality of interchangeable sleeve members for converting the assembly from a male-type microwave device connector to a female-type microwave device connector and vice-versa. Embodiments of the assembly are used for making connections with coaxial microwave electrical connectors and for use in pin depth gauges.

5 Claims, 2 Drawing Sheets

UNIVERSAL CONNECTOR

V-MALE

VF-FEMALE

SS-MALE

SSF-FEMALE

UNIVERSAL CONNECTOR WITH INTERCHANGEABLE MALE AND FEMALE SLEEVES FOR USE IN NETWORK ANALYZERS AND MICROWAVE DEVICES

BACKGROUND OF THE INVENTION

1. Field of the Invention

The present invention relates in general to connectors used in network analyzers, microwave test sets, microwave devices and the like and in particular to a universal coaxial connector with interchangeable male and female sleeves for coupling to male and female type connectors having compatible mechanical geometries and compatible as well as incompatible electrical geometries.

2. Description of the Prior Art

Conventional connectors used for interconnecting microwave components and equipment are typically either male or female and often they are described by their electrical geometry. For example, commonly used conventional connectors include the 7 millimeter connector (type N), the 3.5 millimeter connector, the 2.92 millimeter connector, the 2.4 millimeter connector and the 1.85 millimeter connector. The numbers used refer to the diameter of the outer conductor of the connector which defines the electrical geometry of the connector. All connectors having the same electrical geometry are electrically compatible even though they may not be compatible mechanically because they have different sized coupling nuts, coupling threads and the like.

Heretofore, microwave devices have been made using either male or female type connectors. This can be a problem when it is necessary to interconnect two devices that do not have compatible mating connectors. For example, if a person wishes to connect two microwave devices, one of which has a male connector, it is necessary that the other device be fitted with a compatible female connector or vice versa. Unfortunately, devices with compatible mating connectors are not always readily available.

To avoid problems when a device with a particular type of connector is required, it has often been necessary in the past to have available two models of the same device, i.e. one with a male connector and the other with a female connector. However, since the cost of microwave devices can be substantial, the practice of having two models of the same device simply to insure the availability of a device having the proper connector is an undesirable expense.

To avoid this expense, male-to-female type adapters have been used. However, most commercially available adapters produce discontinuities in the signal line, loss of signal strength and the like and are not desirable in many applications such as, for example, in network analyzers and other microwave device test equipment.

SUMMARY OF THE INVENTION

In view of the foregoing, principal objects of the present invention are a method and apparatus comprising a universal coaxial microwave connector which is usable with a plurality of interchangeable male and female sleeves for making the universal connector either a male or a female type connector.

Another object of the present invention is a universal connector as described above wherein each of the sleeves has a standard mechanical geometry including a standard coupling thread at one end for coupling the sleeve to the universal connector and another mechanical geometry including a coupling thread of any desired type at its opposite end for coupling to a device having the same type of mechanical geometry and coupling thread. The latter mechanical geometry and coupling thread are formed on the body of the female sleeve or in the interior of a coupling nut in the male sleeve. What is important to note is that regardless of the sleeve used or the mechanical geometry of the sleeve and sleeve mating threads, the electrical geometry of the universal connector is preserved. This allows the universal connector with the appropriate sleeve to be used for mating with other connectors having the same mechanical and electrical geometries, different mechanical geometries, but the same electrical geometries, as well as for mating with other connectors having different mechanical geometries a well as different electrical geometries as may be acceptable in certain non-electrical testing applications, e.g. pin depth gauging.

BRIEF DESCRIPTION OF THE DRAWINGS

The above and other objects, features and advantages of the present invention will become apparent from the following detailed description of the accompanying drawings, in which.

DETAILED DESCRIPTION OF THE DRAWINGS

Figure 1:
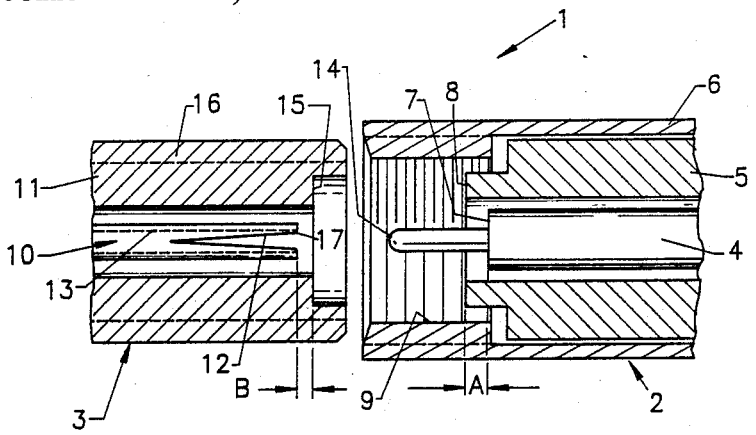
Fig. 1 (PRIOR ART)
FIG. 1 is a representative partial cross-section of a conventional coaxial microwave male and female connector having compatible mechanical and electrical geometries.

Referring to FIG. 1, there is provided in a conventional coaxial microwave connector assembly designated generally as 1, a male connector 2 and a female connector 3. In the male connector 2 there is provided a center conductor 4 having an extended pin portion 14 approximately 1/16 inch long, an outer conductor 5, and a coupling nut 6. The conductors 4 and 5 and the coupling nut 6 are coaxial. At the left end of the center conductor 4 at the base of the pin portion 14 there is provided a radially extending shoulder 7. At the left end of the outer conductor 5 there is provided a radially extending planar surface 8. The interior wall of the left end of the coupling nut 6 is provided with a plurality of threads 9.

In the female connector 3 there is provided a center conductor 10 and an outer conductor 11. The outer diameter of the center conductor 10 is substantially equal to the outer diameter of the center conductor 4 of the connector 2. Conductors 10 and 11 are coaxial. In the center conductor 10 there is provided a slot 12 and a pin receiving bore 13. The slot 12 is provided to permit the right end of the center conductor 10 to expand and contract as the pin portion 14 of the center conductor 4 is inserted in and withdrawn from the bore 13 in the center conductor 10. At its right end the center conductor 10 is provided with a leading wall surface 17. At the right end of the outer conductor 11 there is provided a radially extending planar surface 15. The planar surfaces 8 and 15 of the outer conductors 5 and 11 have substantially equal surface areas for providing mating and reference surfaces. In the exterior wall of the right end of the outer conductor 11 there is provided a plurality of threads 16.

To couple the connectors 2 and 3, the connectors 2 and 3 are screwed together using the threads 9 and 16 until the mating and reference surfaces 8 and 15 abut. As the coupling nut 6 is screwed onto the female connector 3, the pin 14 enters the bore 13 of the center conductor 10.

The surface 7 of the center conductor 4 is recessed from the surface 8 of the outer conductor 5 by a predetermined distance A. Similarly, the surface 17 of the center conductor 10 is recessed from the surface 15 of the outer conductor 11 by a distance B. The distances A and B, called pin depth, are ideally zero distance so that the surfaces 7 and 17 abut when the surfaces 8 and 15 abut. However, due to mechanical tolerance limitations pin depths A and B are slightly larger than zero so as to provide a clearance between the two surfaces 7 and 17 and to thereby insure that the surfaces 8 and 15 abut when the connectors 2 and 3 are screwed together.

In a coaxial microwave connector as shown in FIG. 1, as long as the mating and reference surfaces 8 and 15 of the outer conductors 5 and 11 abut, the diameters of the center conductors 4 and 10 are equal and the dielectric between the center and outer conductors comprises the same material and has the same transverse dimensions, the connectors 2 and 3 will have the same electrical geometry, i.e. be electrically compatible, and therefore will be free of discontinuities which adversely affect signals passing through the connectors. However, it is important to note that aside from the mating and reference planes 8 and 15, the electrical geometry of the connectors 2 and 3 is independent of the wall thickness of the outer conductor 5, the size, shape and type of threads in the coupling nut 6 and the outer diameter and size and shape of the threads 16 in the outer conductor 11 of the connectors 2 and 3, respectively. That is to say, the mechanical geometry of the connectors 2 and 3 which is necessary for mechanical compatibility is independent of the electrical geometries of the connectors 2 and 3 which is necessary for good signal transmission.

Figure 2A:
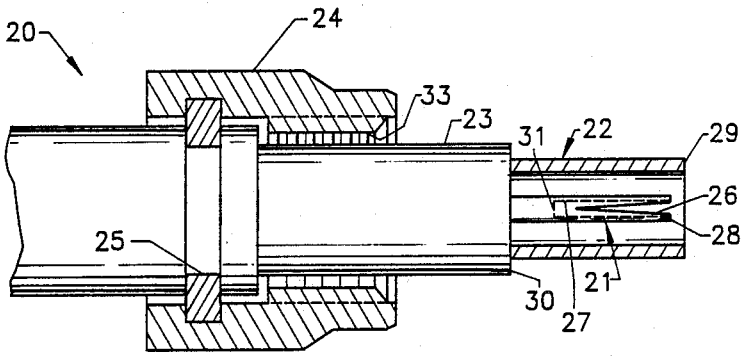
FIG. 2A is a partial cross-section of a universal connector member without its sleeve according to the present invention.
Figure 2B:
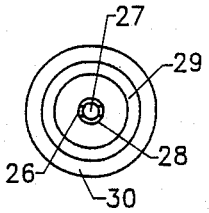
FIG. 2B is an end view of the body member, outer conductor and center conductor of the connector member of FIG. 2A.

Referring to FIGS. 2A and 2B, there is provided in accordance with the present invention a universal connector member designated generally as 20. In the connector member 20 there is provided in a coaxial arrangement a center conductor 21, an outer conductor 22, located within a cylindrical body member 23 and a coupling nut 24 which is rotatably mounted on the body member 23 by means of a snap ring 25 or the like. In the center conductor 21 there is provided a slot 26, a central bore 27 having a bottom wall 31 and a leading wall surface 28. In the outer conductor 22 there is provided a mating and reference planar surface 29. At the end of the body member 23 there is provided a radially extending shoulder 30. In the coupling member 24 there is provided in the interior wall thereof a plurality of coupling threads 33 of a predetermined size and type such as, for example, ¼-36 UNS-2A.

Figure 2C:
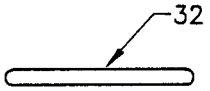
FIG. 2C is a side view of a pin used in the center conductor of the connector member of FIG. 2A when said connector member is assembled as a male-type connector.

Referring to FIG. 2C, there is provided in accordance with the present invention a cylindrical pin 32. Pin 32 has a length approximately equal to the sum of the depth of the bore 27 in the center conductor 21 of the connector member 20 of FIG. 2A and the length of the pin portion 14, i.e. 0.0625 inch, of the center conductor 4 of the connector 2 of FIG. 1. In use, pin 32 is inserted in the bore 27 of the center conductor 21 of connector member 20 of FIG. 2A when connector member 20 is used with the male sleeves of FIGS. 3 and 5, as will be described below.

Figure 3:
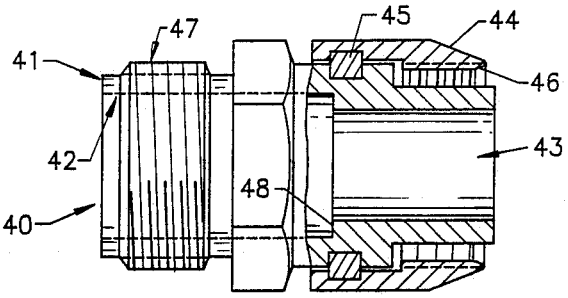
FIG. 3 is a partial cross-section of a male sleeve which is used with the universal connector member of FIG. 2A for making a mechanically and electrically compatible coupling to a V-type 1.85 millimeter (1.85 mm) female connector.

Referring to FIG. 3, there is provided in accordance with the present invention a male sleeve designated generally as 40. In the sleeve 40 there is provided a generally cylindrical body member 41. In the left end of the body member 41 there is provided a centrally located bore 42 having a diameter of about 0.175 inch and in the right end thereof a centrally located bore 43 having a diameter of about 0.1275 inch and a depth of about 0.239 inch. The outside diameter of the right end of the body member 41 is about 0.186 inch for a depth of about 0.131 inch. The diameter of the bore 42 is slightly larger than the diameter of the body member 23 so as to provide a close fit with respect thereto when the sleeve 40 is fitted on the connector member 20. Similarly, the diameter of the bore 43 is slightly larger than the diameter of the outer conductor 22 of the connector member 20 so as to provide a close fit thereto. The bore 42 is terminated at its internal end by means of a radially extending shoulder 48. When the sleeve 40 is fitted on the connector member 20, the shoulder 30 of the connector member 20 seats on the shoulder 48. The depth of the bore 43 is slightly less than the distance between the shoulder 30 and the surface 29 of the connector member 20 so that the surface 29 extends beyond the right end of the bore 43 by approximately 0.001 inch when the sleeve 40 is fitted on the connector member 20.

A coupling nut 44 is rotatably mounted to the sleeve 40 by means of a snap ring, or the like, 45. Along an interior wall of the coupling nut 44 there is provided a plurality of threads 46. At the left end of the sleeve 40 there is provided a plurality of threads 47. The threads 47 correspond to the threads 31 of the connector member 20. The threads 46, in metric measurement, comprise 7.0×0.75-6 g threads. The threads 46 and the geometry of the coupling nut 44 and the geometry of the right end of the sleeve 40 are mechanically compatible with the mechanical geometry of a female V-type connector. V-type is the connector designation for a 1.85 mm connector made by the Wiltron Company of Morgan Hill, Calif., which is also mechanically compatible with a conventional 2.4 mm connector such as made by Hewlett-Packard Company, Palo Alto, Calif.

In use, after the pin 32 of FIG. 2C is inserted in the bore 27 of the center conductor 21 of the connector member 20 of FIG. 2A, the sleeve 40 is fitted over the body member 23 of the connector member 20. The coupling nut 24 of the connector member 20 is then threaded onto the threads 47 of the sleeve 40, drawing the sleeve 40 onto the body member 23 until the shoulder 30 of the connector member 20 seats on the shoulder 48 of the sleeve 40. As described above, when the shoulder 30 of the connector member 20 seats on the shoulder 48 of the sleeve 40, the mating and reference surface 29 and the exposed end of the pin 32 of the connector member 20 will extend beyond the bore 43 by approximately 0.001 and 0.0625 inch, respectively.

The assembly of the sleeve 40 and connector member 20 produces a male connector which is mechanically and electrically compatible with a conventional female V-type connector, as described above, having 1.85 mm geometry. The assembly of the sleeve 40 and the connector member 20 is also mechanically, though not electrically, compatible with the conventional 2.4 mm connector which is commercially available from Hewlett-Packard Company, Palo Alto, Calif.

Figure 4:
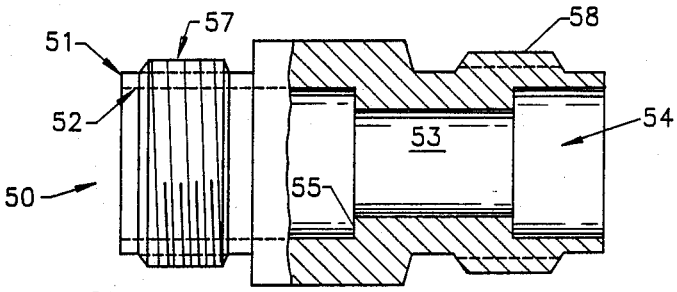
FIG. 4 is a cross-section of a female sleeve which is used with the universal connector member of FIG. 2A for making a mechanically and electrically compatible coupling to a V-type 1.85 mm male connector.

Referring to FIG. 4, there is provided in another embodiment of the present invention a female sleeve designated generally as 50. In the sleeve 50 there is provided a generally cylindrical body member 51. In the body member 51 there is provided a central bore 52, a central bore 53 and a central bore 54. The bore 52 has a length and diameter substantially equal to the length and diameter of the bore 42 of the sleeve 40 described above with respect to FIG. 3. The bore 53 has a length and diameter approximately equal to the bore 43 of the sleeve 40 described above with respect to FIG. 3. The bore 54 has a diameter of approximately 0.1885 inch and a depth of approximately 0.121 inch for receiving the end of a male V-type connector having an outside diameter of approximately 0.186 inch. The interior end of the bore 52 is terminated by a radially extending shoulder 55. At the left end there is provided on an exterior wall of the body member 51 a plurality of threads 57 which are identical to the threads 47 of the sleeve 40 of FIG. 3. On an exterior wall of the right end of the sleeve 50 there is provided a plurality of threads 58 which are identical to the threads 46 of the sleeve 40.

In use, with the pin 32 of FIG. 2C removed from the center conductor 21 of the connector member 20 of FIG. 2A, the sleeve 50 is fitted over the connector member 20 and coupled thereto by means of the coupling nut 24. As the coupling nut 24 is rotated, the sleeve 50 is drawn onto the connector member 20 until the shoulder 30 seats on the shoulder 55. When the shoulder 30 seats on the shoulder 55, the reference surface 29 of the outer conductor 22 of the connector member 20 projects a short distance, e.g. 0.001 inch, into the cavity formed by the bore 54. An assembly of the sleeve 50 and the connector member 20 forms a female connector which is mechanically and electrically compatible with a V-type 1.85 mm male connector, as described above, as well as a 2.4 mm male connector commercially available from Hewlett-Packard Company, Palo Alto, Calif.

Figure 5:
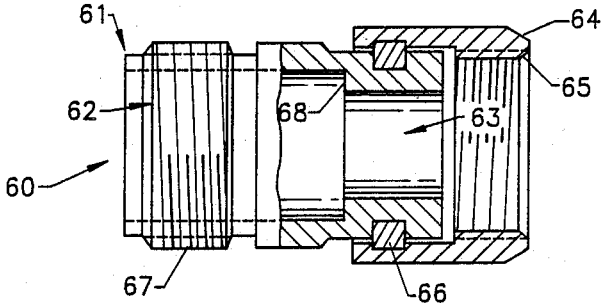
FIG. 5 is a cross-section of a male sleeve which is used with the universal connector member of FIG. 2A for making a mechanically and electrically compatible coupling to an SS-type 1.85 mm female connector.

Referring to FIG. 5, there is provided in another embodiment of the present invention a male sleeve designated generally as 60. In the sleeve 60 there is provided a generally cylindrical body member 61. In the body member 61 there is provided a central bore 62 and a central bore 63. The depth and diameter of the bore 62 is approximately equal to the depth and diameter of the bore 42 of the sleeve 40 and the bore 52 of the sleeve 50. The bore 63 has a diameter approximately 0.1275 inch, substantially equal to the diameters of the bores 43 and 53 of the sleeves 40 and 50, respectively. The depth of the bore 63 is 0.150 inch such that when the sleeve 60 is fitted over the connector member 20, the reference surface 29 of outer conductor 22 of the connector member 20 extends beyond the bore 63 by approximately 0.095 inch, an amount slightly larger than the depth, 0.078 inch, of the bore 74 of the connector 70 which will be described below with reference to FIG. 6. Rotatably mounted to the right end of the sleeve 60 there is provided a coupling nut 64. An interior wall of the coupling nut 64 is provided with threads 65, e.g. 10–36 UNS-2A threads. At the left end of the coupling nut 64, the coupling nut 64 is rotatably mounted to the sleeve 60 by means of a snap ring 66, or the like. On the left end of an exterior wall of the body member 61 there is provided a plurality of threads 67. Threads 67 are identical to threads 47 of the sleeve 40 and the threads 57 of the sleeve 50 for threadably attaching the sleeve 60 to the connector member 20. The interior of the bore 62 is terminated by a radially extending shoulder 68.

In use, after pin. 32 of FIG. 2C is inserted in the bore 27 of the center conductor 21 of the connector member 20 of FIG. 2A, the sleeve 60 is fitted over the connector member 20 and attached thereto by means of the coupling nut 24. As the coupling nut 24 is threaded onto the threads 67, the sleeve 60 is drawn onto the connector member 20 until the mating and reference surface 30 abuts the shoulder 68. When the surface 30 abuts the shoulder 68, the mating and reference plane 29 and pin 32 extend beyond the bore 63. The surface 29 extends beyond the bore 63 by about 0.095 inch, an amount slightly larger than the depth of the bore 74 of the sleeve 70 which will be described below with respect to FIG. 6. The pin 32 extends further, e.g. 0.0625 inch so as to make a good electrical connection with the center conductor of the mating female connector. The assembly of the sleeve 60 and the connector member 20 form a male SS-type connector which is mechanically and electrically compatible with a female SS-type connector. SS-type is the connector designation for a 1.85 mm connector made by Wiltron Company of Morgan Hill, Calif. which is also mechanically compatible with a conventional SSMA connector such as made by Hewlett-Packard Company, Palo Alto, Calif.

Figure 6:
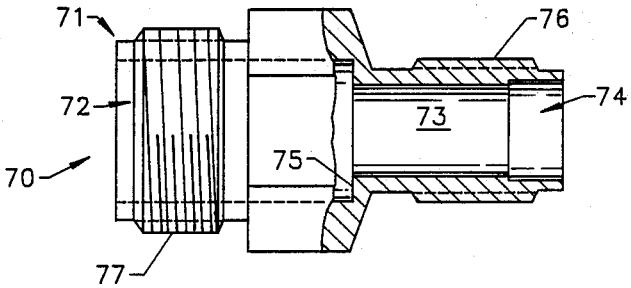
FIG. 6 is a cross-section of a female sleeve according to another embodiment of the present invention which is used with the universal connector member of FIG. 2A for making a mechanically and electrically compatible coupling to an SS-type 1.85 mm male connector.

Referring to FIG. 6, there is provided in another embodiment of the present invention a female sleeve designated generally as 70. In the sleeve 70 there is provided a cylindrical body member 71. In the body member 71 there is provided a central bore 72, a central bore 73, and a central bore 74. The central bore 72 has a depth and a diameter substantially equal to the depth and diameter of the bore 42 of the sleeve 40, the bore 52 of the sleeve 50 and the bore 62 of the sleeve 60. The bore 73 has a length and diameter substantially equal to the bores 43 and 53 of the sleeves 40 and 50, i.e. 0.2390 inch and 0.1275 inch, respectively. The bore 74 has a diameter of approximately 0.128 inches and a depth of approximately 0.078 inches. The interior of the bore 72 is terminated by a radially extending shoulder 75. On an exterior surface of the right end of the sleeve 70 there is provided a plurality of threads 76. Threads 76 comprise 10–36 UNS-2A threads. On the left end of the sleeve 70 there is provided a plurality of threads 77. Threads 77 are identical to the threads 47 of the sleeve 40, the threads 57 of the sleeve 50 and the threads 67 of the sleeve 60 for coupling the sleeve 70 to the connector member 20.

In use, with the pin 32 of FIG. 2C removed from the center conductor 21 of the connector member 20 of FIG. 2A, the sleeve 70 is fitted over the connector member 20 and coupled thereto by the coupling nut 24. As the coupling nut 24 is rotated, the sleeve 70 is drawn thereon until the surface 30 of the connector member 20 abuts the shoulder 75 of the sleeve 70. When the surface 30 of the connector member 20 abuts the shoulder 75 of the sleeve 70, the mating and reference surface 29 of the connector member 20 extends a short distance, e.g. 0.001 inch, into the cavity formed by the bore 74.

The assembly of the sleeve 70 and the connector member 20 form a female connector which is mechanically and electrically compatible with a conventional male SS-type connector as described above.

Figure 7:
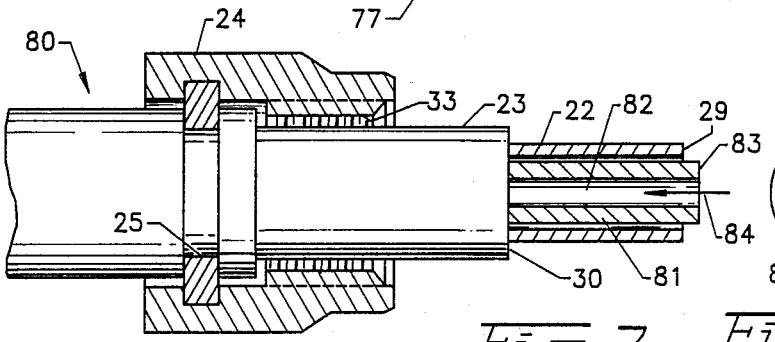
FIG. 7 is a partial cross-section of a universal connector member without its sleeve for use in a pin depth gauge according to the present invention.
Figure 8:
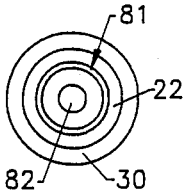
FIG. 8 is a partial end view of the connector member of FIG. 7.

Referring to FIGS. 7 and 8, there is shown in another embodiment of the present invention a universal connector member designated generally as 80 which is adapted for use in pin depth gauges for measuring the pin depth of a variety of male and female microwave connectors. The features of the connector member 80 which are identical to the connector member 20 of FIG. 2 bear the same numerical designation and are described above with respect to the connector member 20 of FIG. 2. In addition to the above-described features, there is provided in the connector member 80 a movable center member 81 which takes the place of the center conductor 21 of FIG. 2. In the center member 81 there is provided a bore 82. The bore 82 is provided for freely receiving the pin portions of the center conductors of male type microwave connectors, such as the pin portion 14 of the male connector 2 of FIG. 1. The diameter of the bore 82 is slightly larger than the diameter of the pin portion of the male connectors so that the pin portion is freely received therein. The right end of the member 81 having a radially extending surface 83 extends beyond the surface 29 of the member 22 by an amount which slightly exceeds normally expected pin depths. The left end of the movable member 81 is mechanically connected to a needle gauge or the like in any suitable manner such as is now used in commercial pin depth gauges.

In use, one of the sleeves 40, 50, 60 or 70, described above with respect to FIGS. 3–6, is fitted on the connector member 80. After the selected sleeve is fitted on the connector member 80 and coupled thereto by means of the coupling nut 24, the coupling nuts 44 and 64 of the sleeves of FIGS. 3 and 4 and the threads 46 and 76 of the sleeves of FIGS. 4 and 6 are used in a conventional manner for coupling the sleeves to a connector in which the pin depth is to be measured. Thus, as the connector member 80 and one of the sleeves described above is coupled to a connector, the surface 83 of the movable member 81 engages the shoulder of the center conductor of a male connector such as shoulder 7 of connector 2 of FIG. 1, or the leading edge of the center conductor of a female connector such as surface 17 of the center conductor 10 of FIG. 1, moving the connector 81 in the direction of the arrow 84, thereby providing a measure of the pin depth A or B, as the case may be.

While preferred embodiments of the present invention are described above, it is contemplated that various modifications may be made thereto without departing from the spirit and scope of the present invention. For example, other universal connector members and male and female sleeves having coupling nuts and mechanical geometries which are compatible with other connectors may be made incorporating the principles of the connector member 20 and sleeves 40, 50, 60 and 70 described above. Accordingly, it is intended that the embodiments described be considered only as an illustration of the present invention and that the scope thereof should not be limited thereto but be determined by reference to the claims hereinafter provided.

What is claimed is:

1. A universal connector assembly for use in microwave apparatus comprising:

a first cylindrical member, said first cylindrical member having a first and a second section, each having a bore centrally located therein, said first section having a first outside diameter and said second section having a second outside diameter, said second diameter of said second section being less than said first diameter of said first section for forming a radially extending shoulder therebetween;

a second cylindrical member centrally located within said bore of and spaced from said first and said second sections of said first cylindrical member, said second cylindrical member having a pin receiving bore centrally located therein;

a cylindrical sleeve member, said sleeve member having a first section with a first bore having a first diameter centrally located therein and a second section with a second bore having a second diameter centrally located therein for forming a radially extending shoulder therebetween, said first and said second sections of said sleeve member being adapted to be closely fitted over said first and said second sections, respectively, of said first cylindrical member, said length of said second bore in said sleeve member being less than the length of said second section in said first member so that the end of said second section in said first member extends beyond the end of said second bore in said sleeve member when said shoulder in said first member abuts said shoulder in said sleeve member;

first means for removably coupling said cylindrical sleeve member to said first cylindrical member such that said shoulder in said sleeve member abuts said shoulder in said first member; and second means for removably coupling said sleeve member to a mechanically compatible connector.

2. An assembly according to claim 1 comprising a pin member which is removably inserted in said pin receiving bore in said second cylindrical member for converting said assembly from a female-type electrical connector to a male-type electrical connector.

3. An assembly according to claim 1 wherein said second section of said first cylindrical member comprises an outer electrical conductor and said second cylindrical member comprises a center electrical conductor which is electrically insulated from said outer electrical conductor.

4. An assembly according to claim 1 wherein said sleeve member comprises a third section with a third bore having a third diameter, said third diameter of said third bore in said third section of said sleeve member being larger than said second diameter of said second bore in said second section of said sleeve member for receiving the end of a mechanically compatible male connector.

5. An assembly according to claim 1 wherein said second cylindrical member is movable relative to said first and said second section of said first cylindrical member in a direction parallel to the axis of said first and said second sections in said first cylindrical member and the end of said second cylindrical member extends beyond the end of said second section in said first cylindrical member when said assembly is used in a pin depth gauge.

* * * * *